United States Patent [19]

Coughlin

[11] 4,268,363

[45] May 19, 1981

[54] METHOD FOR ELECTROWINNING METALS

[76] Inventor: Robert W. Coughlin, 49 Storrs Heights Rd., Storrs, Conn. 06268

[21] Appl. No.: 67,769

[22] Filed: Aug. 20, 1979

Related U.S. Application Data

[63] Continuation-in-part of Ser. No. 840,567, Oct. 11, 1977.

[51] Int. Cl.[3] ..... C25B 1/00; C25B 1/08; C25B 1/12

[52] U.S. Cl. ..... 204/39; 204/105 R; 204/105 M; 204/106; 204/107; 204/108; 204/112; 204/113; 204/116; 204/117; 204/118; 204/119; 204/101

[58] Field of Search ..... 204/59 R, 130, 131, 204/80, 73 R, 294, 101, 105 M, 105 R, 106-108, 112-113, 116-119, 39

[56] References Cited

U.S. PATENT DOCUMENTS

| | | | |
|---|---|---|---|
| 1,954,674 | 4/1934 | Lager | 47/17 |
| 3,718,629 | 2/1973 | Heck | 204/80 |
| 3,870,611 | 3/1975 | Vestal | 204/73 R |
| 3,919,062 | 11/1975 | Lundquist, Jr. et al. | 204/294 |
| 3,930,969 | 1/1976 | Chen | 204/105 R |
| 4,043,881 | 8/1977 | Yen | 204/130 |
| 4,043,884 | 8/1977 | Yen | 204/130 |
| 4,073,702 | 2/1978 | Fleischmann et al. | 204/105 R |
| 4,108,757 | 8/1978 | Fleet | 204/294 |

OTHER PUBLICATIONS

"Coal Cuts Energy Use In Metal Electrowinning" C & EN, 8-10-79, pp. 28-29.

*Primary Examiner*—R. L. Andrews
*Attorney, Agent, or Firm*—Martin Novack

[57] ABSTRACT

Electrochemical gasification of carbonaceous materials by anodic oxidation produces oxides of carbon at the anode and hydrogen or metallic elements at the cathode of an electrolysis cell. In another embodiment carbonaceous materials are hydrogenated at the cathode by electrochemical reactions during which carbonaceous material may also be anodically reacted within the anode compartment of an electrolysis cell.

18 Claims, 4 Drawing Figures

METHOD FOR ELECTROWINNING METALS

The Government has rights in this invention pursuant to Grant No. EF-77-G-01-2731.

BACKGROUND OF THE INVENTION

This is a continuation-in-part of U.S. Application Ser. No. 840,567, filed Oct. 11, 1977. The present invention relates to methods for electrowinning of metals and methods for hydrogenation of carbonaceous materials.

The prior art of electrodeposition or electrowinning of metals may be represented by the cathodic production of copper from aqueous solution thereof. For example, U.S. Pat. No. 3,804,733 to Bennion and Newman discloses process and apparatus in which the anodic reaction is the dissolution of copper which is simultaneously electrodeposited from solution upon a highly porous cathode of an electrochemical cell. The cathodic electrodeposition of copper can also be accompanied by other anodic reactions such as the production of oxygen, or the oxidation of $Fe^{2+}$ to $Fe^{3+}$ if sufficient ferrous ion ($Fe^{2+}$) is present in solution.

The hydrogenation of coal can produce a number of desirable products. For example, U.S. Pat. No. 3,152,068 to Schroeder et al discloses a hydrogenation process by which coal is converted to tar, liquids and gaseous hydrocarbons. U.S. Pat. No. 3,535,224 describes a process for producing hydrogen-enriched hydrocarbonaceous products from particulate coal. In general hydrogenated coal or the products produced therefrom by hydrogenation are useful and valuable products. Heretofore the art of hydrogenating coal and other solid carbonaceous material has generally involved the direct use of hydrogen as a reactant and at pressures and temperatures significantly higher than one atmosphere and room temperature.

SUMMARY OF THE INVENTION

Applicant has demonstrated, e.g. in the above-referenced copending U.S. Application Ser. No. 840,567, that carbonaceous material such as coal can be oxidized at the anode of an electrochemical cell containing an aqueous electrolyte with the simultaneous production of oxides of carbon and hydrogen ions. For example, focusing on the carbon in coal and representing it by C, this anodic reaction can be written according to the stoichiometry:

$$C_{(s)}+2H_2O_{(l)}\rightarrow CO_{2(g)}+4H^{+}+4e^{-}\ E^{\circ}=0.21\text{ volt} \qquad \text{(I)}$$

The simultaneous cathodic process disclosed in the referenced copending application is:

$$4H^{+}+4e^{-}\rightarrow 2H_{2(g)}E^{\circ}=0.0\text{ volt} \qquad \text{(II)}$$

The net reaction, that is the sum of equations (I) and (II) is:

$$2H_2O_{(l)}+C_{(s)}\rightarrow CO_{2(g)}+2H_{2(g)}E^{\circ}=0.21\text{ volt} \qquad \text{(III)}$$

In these equations, and those which follow, $E^{\circ}$ is the standard thermodynamic electrode potential and the symbols (g) (s) and (l) symbolize the gaseous, solid and liquid states respectively. Equation (III), the reaction between coal and water, caused by impressing a potential of 0.21 volt or more on a suitable electrochemical cell, and which is described in further detail in the referenced copending application, is what I have referred to as the electrochemical gasification of coal.

The conventional electrolysis of water by which oxygen is produced at the anode:

$$2H_2O_{(l)}\rightarrow O_{2(g)}+4H^{+}+4e^{-}\ E^{\circ}=1.23\text{ volt} \qquad \text{(IV)}$$

may also be written by combining the anodic reaction (IV) with the cathodic reaction (II) to give:

$$2H_2O_{(l)}\rightarrow O_{2(g)}+2H_{2(g)}E^{\circ}=1.23\text{ volt} \qquad \text{(IV)A}$$

It should be noted that substituting the anodic oxidation of coal, equation (I), for the more usual anodic production of oxygen in conventional water electrolysis, equation (IV), has two important effects: (1) instead of gaseous oxygen production at the anode, gaseous oxides of carbon are formed [$CO_2$ is specified in Equations (I) and (III), but CO may also be produced] and (2) by virtue of the anodic oxidation of carbonaceous material the theoretical reversible, thermodynamic cell voltage is reduced by about one volt. Even in actual operating electrolysis cells where it is necessary to operate at irreversible potentials larger than those predicted by thermodynamics, however, the difference between the practical, irreversible operating potentials for reactions (III) and (IV)A is still about one volt.

As will be elucidated further below, even when other reactions take place at the cathode (e.g. deposition of a metal), the substitution of reaction (I) for reaction (IV) as the anodic reaction still results in a lowering of the practical operating cell potential, often by as much as one volt. Such a lowering in operating potential can have a very significant effect in lowering the consumption of electrical energy because electric power consumption is proportional to the product of cell voltage and cell current. Thus the electrochemical gasification of a carbonaceous material such as coal at the anode of an electrolysis cell simultaneously produces gaseous oxides of carbon at the anode and can lower the operating cell potential, often by as much as one volt with consequent lowered consumption of electric energy. Such beneficial effects of electrochemical gasification of coal at the anode occur regardless of the nature of the simultaneous cathodic reaction which, for example, can be production of hydrogen (as described in detail in the referenced copending application), the electrodeposition of a metal, or the hydrogenation of coal.

The present invention provides method and apparatus for the electrochemical gasification of coal in an anodic half-cell reaction, Reaction (I), in combination with the cathodic half-cell reaction of electrodeposition of a metal M from an aqueous solution of its ions $M^{m+}$:

$$M^{m+}+me^{-}\rightarrow M \qquad \text{(V)}$$

or, in combination with the cathodic half-cell reaction for the hydrogenation of coal (here represented by the symbol C):

$$C_{(s)}+xH^{+}+xe^{-}\rightarrow CH_x \qquad \text{(VI)}$$

The combination of half-cell reaction (I) with reaction (V) gives the net reaction (for the case m=1):

$$C_{(s)}+2H_2O_{(l)}+4M^{+}\rightarrow CO_{2(g)}+4M+4H^{+} \qquad \text{(VII)}$$

The acidic hydrogen ions produced in reaction (VII) can be employed to dissolve more of the metal M, for example from an oxidic ore, $M_2O$ or from an impure metallic ingot by reactions such as:

$$2M_2O_{(s)}+4H^+ \rightarrow 4M^+ + 2H_2O_{(l)}, \text{ or} \quad \text{(VIII)}$$

$$4M(\text{impure})+4H^+ \rightarrow 4M^+ + 2H_{2(g)} \quad \text{(IX)}$$

In the case of copper, for example, equations (VII), (VIII) and (IX) in combination would take the forms:

$$C_{(s)}+2H_2O_{(l)}+2Cu^{2+} \rightarrow CO_{2(g)}+2Cu_{(s)}+4H^+ \quad \text{(X)}$$

(the coal-assisted electrodeposition of copper)

$$2CuO_{(s)}+4H^+ \rightarrow 2Cu^{2+}+2H_2O_{(l)} \quad \text{(XI)}$$

(acid dissolution of CuO ore)

$$2Cu(\text{impure})+4H^+ \rightarrow 2Cu^{2+}+2H_2 \quad \text{(XII)}$$

(acidic dissolution of Cu ingot)

It should be recognized that reactions (VII) or (X) can take place simultaneously with reaction (III) so that it is also possible to produce some hydrogen gas at the cathode by reaction (III) as well as cathodic metal electrodeposition by reaction (VII) or (X). The relative amount of reaction (III) that will take place will depend on the conditions of operation, especially $H^+$ concentration, $M^{m+}$ concentration, cell potential and current density. Whatever the cathodic reaction, however, the anodic oxidation (or electrochemical gasification) of coal at the anode [i.e., by equation (I)], instead of the more usual anodic production of oxygen by equation (IV), permits operation at lower cell potential (often about one volt lower, or better) and this permits a corresponding savings in the expenditure of electrical energy.

Turning now to the cathodic reaction for the hydrogenation of coal, Equation (VI), it is not evident that such a half-cell reaction will occur but, in fact, it is demonstrated below in Example 3 that the reaction of Equation (VI) does indeed take place. When the Equation (VI) half cell reaction for cathodic hydrogenation of coal is combined with Equation (I) for the anodic electro-oxidation of coal, the net overall reaction is:

$$(z+1)C_{(s)}+2H_2O_{(l)} \rightarrow CO_{2(g)}+zCH_x+(2-xz/2)H_{2(g)} \quad \text{(XIII)}$$

According to Equation (XIII), one mole of C is electrochemically gasified at the anode and z moles of C are hydrogenated at the cathode to produce the hydrocarbonaceous product represented by $CH_x$; it is seen that some hydrogen may also be produced at the cathode, i.e., (2-xz/2) moles and the magnitude of this amount of hydrogen will depend on the values of x and z and, therefore, on operating conditions. The anodic oxidation (or electrochemical gasification) of coal at the anode [i.e., by Equation (I)], instead of the anodic production of oxygen by equation (IV), permits the overall cell reaction, in which coal is electrochemically hydrogenated at the cathode, to take place at lower potential (often about one volt lower, or better), with corresponding savings in the expenditure of electrical energy.

In the foregoing discussion aqueous electrolytes have been implied or assumed but the electrolytes need not be aqueous in every case. For the case of coal hydrogenation at the cathode, aqueous electrolytes will usually be preferred but essentially any electrolyte can be used which will provide the hydrogen ions to be reduced at the cathode, thereby providing the hydrogen there for the hydrogenation of coal. Neither are aqueous electrolytes necessary for the anodic oxidation of coal or the cathodic electrodeposition of metal; for example, molten-salt electrolytes could be used in which case the coal could react anodically with a molten metal oxide, for example, to produce gaseous oxides of carbon and metal ions which would be free to migrate through the molten salt electrolyte to the cathode where the metal ions would be discharged to accomplish electrodeposition of the metal. In the case of molten electrolyte containing a metal chloride the anodic reaction can be the chlorination of coal (e.g. the gaseous carbon chlorides, oxychlorides or compounds of carbon, hydrogen and chlorine); metal electrodeposition at the cathode would result from the migration, through the melt, of metal cations to the cathode. Some representative stoichiometric relationships are:

$$C_{(s)}+4Cl^- \rightarrow CCl_{4(g)}+4e^- \quad \text{(XIV)}$$

(at the anode)

and $$2M^{2+}+4e^- \rightarrow 2M^{\circ}_{(s \text{ or } l)} \quad \text{(XV)}$$

(at the cathode)

where M represents a metal such as Cu. The net overall reaction would be:

$$2MCl_{2(l)}+C_{(s)} \rightarrow 2M^{\circ}_{(s \text{ or } l)}+CCl_{4(g)} \quad \text{(XVI)}$$

DESCRIPTION OF THE PREFERRED EMBODIMENTS

Figure 1:
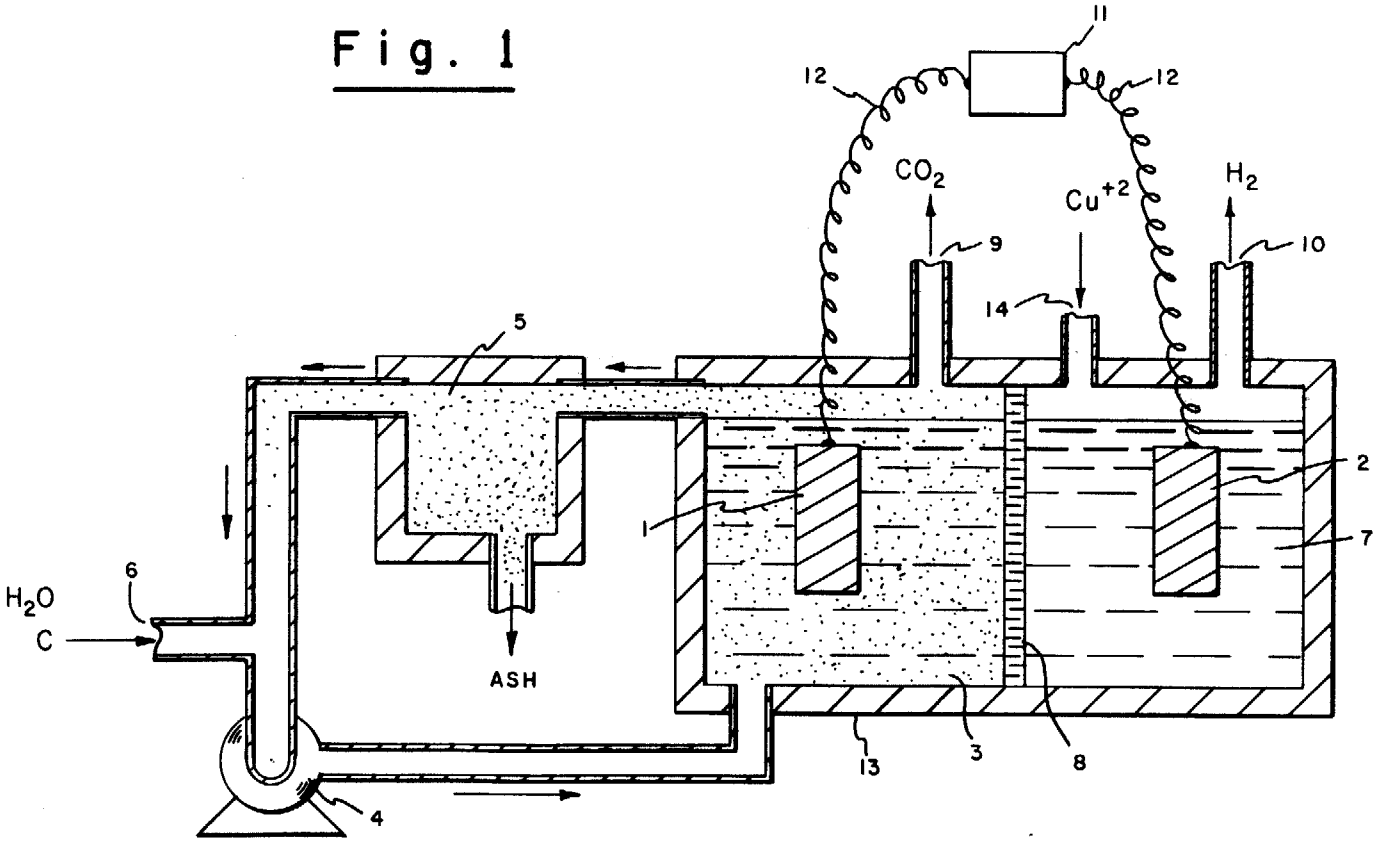
FIG. 1 is a schematic drawing of an electrochemical cell in which coal or other carbonaceous material is gasified at the anode and copper is electrodeposited simultaneously at the cathode.

FIG. 1 shows schematically an embodiment which provides electrochemical gasification of coal at anode 1 combined with electrodeposition of copper at cathode 2. Anolyte electrolyte 3 is circulated by pump means 4 carrying with it carbonaceous material and ash; the ash is separated by gravity settling in settling-chamber means 5. Carbonaceous material such as coal is fed at 6 and contacts the anode 1. Required make-up water or aqueous electrolyte is also fed at 6. The cell of FIG. 1 also includes cathode 2, catholyte electrolyte 7, membrane 8 which is permeable to ions but not coal particles, and means for removing $CO_2$ at 9 and $H_2$ at 10 in case any $H_2$ is generated. Anode 1 and cathode 2 are electrically connected to DC power source 11 by wires 12. Suitable operating overall cell potentials for the process and apparatus of FIG. 1 are about 0.6 or 0.7 volts or higher. In preferred embodiments of the invention the circulation of electrolyte, ash, and carbonaceous material through anode compartment 13 will constitute a fluidized-bed, moving-bed, expanded-bed or pumped-slurry electrodes; such three-dimensional electrodes being disclosed, for example, in British Pat. No. 1,194,181; articles by Fitzjohn (Chemical Engineering Progress 71, No. 2, pp. 85–91, Feb. 1975); Brockhurst et al (J. Electrochem Soc. 116, No. 11, pp. 1600–1607 (1969); Baria et al (J. Electrochemical Soc. 120, No. 10, pp. 1333–1339 (1973) and in U.S. Pat. No. 3,645,864. It may often be desirable to add small, corrosion-resistant, conducting particles to the circulating anolyte 3 of FIG. 1 to facilitate contact and current flow between solid particles of carbonaceous material and the anode; in such instances the solid carbonaceous material, the said conductive particles and ash particles (if any) would be suspended in the electrolyte 3 and circulate therewith; ash is separated selectively from carbonaceous material and conductive particles by settling-chamber means at 5 or by other means well known in the art.

A salient feature of the process and apparatus of FIG. 1 is the electrodeposition of copper on cathode 2. Copper ions, $Cu^{2+}$ are fed to the cell at point 14 in a solution of suitable concentration and composition, e.g. an aqueous solution 20% in $CuSO_4$ and 20% in $H_2SO_4$. The cathode 2 may be of almost any electrical conductor and copper will deposit and build up on cathode 2 as the process progresses. Suitable types of designs for cathode 2 are given in aforesaid U.S. Pat. No. 3,804,733 and by Ammann et al in Chapter 51 of *Extractive Metallurgy of Copper, An International Symposium,* vol. 11, ed. by Yannepoulos et al, The Metallurigcal Society, N.Y. 1976. In preferred embodiments hereof it may be necessary and desirable to periodically remove cathode 2 after considerable elemental copper metal has been deposited upon it and substitute a fresh cathode to accumulate more copper. Means are shown at 10 to remove hydrogen in case any is generated. In the event excess hydrogen ions build up in the system in accord with Reaction (X) means must be provided for removal or neutralization of this $H^+$ but this is not shown in FIG. 1. Advantageous ways to utilize this acidic $H^+$ were discussed above in connection with Reactions (XI) and (XII); Reaction (XII) is further elucidated by the process shown in the schematic diagram of FIG. 2.

Figure 2:
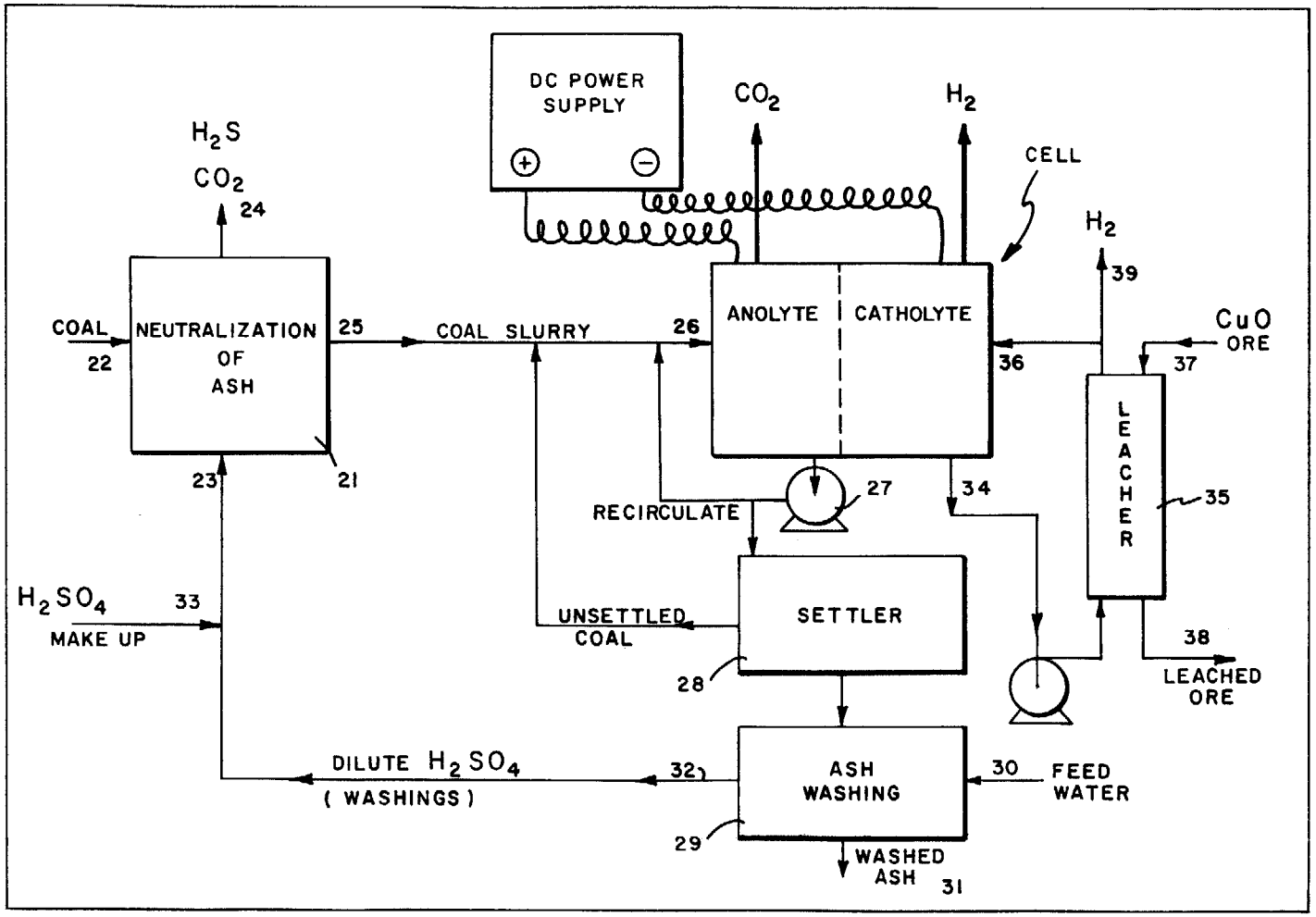
FIG. 2 is a schematic, flow diagram showing the electrochemical cell of FIG. 1 incorporated into a process for dissolution of CuO ore with subsequent electrowinning of the Cu at the anode of the cell.

FIG. 2 shows the copper electrodeposition cell of FIG. 1 operating in concert with a more elaborate coal-handling scheme than shown in FIG. 1, and also including means for leaching $Cu^{2+}$ ions from CuO ore. Referring to FIG. 2, coal and acidic electrolyte are fed to neutralization vessel 21 at 22 and 23, and gases such as $CO_2$ and $H_2S$ formed by neutralization of basic components of the coal ash are withdrawn at 24. Coal slurried in acidic electrolyte flows from the neutralizer 21 at 25 to the anode compartment of the cell at 26. Pump means 27 are provided for recirculating the anolyte coal slurry thereby keeping it in motion within the anode compartment of the cell so that the coal can make contact with the anode. A portion of the coal slurry flows from pump means 27 to settling means 28 where ash is removed and washed in the washing unit 29. Feed wash water is fed at 30, washed ash is removed at 31, and the dilute-electrolyte washings are recirculated via conduit 32 to the neutralization vessel at 23. Make-up acid is added to the system as needed at 33 and a D.C. electrical potential is applied to the electrode of the cell from the DC power supply. A feature of the process and flow scheme of FIG. 2 is the provision to circulate acidic catholyte from the cell at 34 to a leaching unit 35 where $Cu^{2+}$ ions are leached from the ore and fed to the cell at 36. Provision is shown for feeding ore to the leacher 35 at 37 and removing leached ore at 38. Provision is also shown at 39 for removing $H_2$ formed in the leaching operation. The process of FIG. 2 is fed with coal, feed water, make-up acid as needed and Cu ore; the products removed are leached ore, washed ash, gaseous oxides of carbon from the cell, hydrogen (if any is produced) from the cell, and purified elemental Cu which accumulates at the cathode of the cell and can be removed periodically by removing the cathode and substituting a new one.

Figure 3:
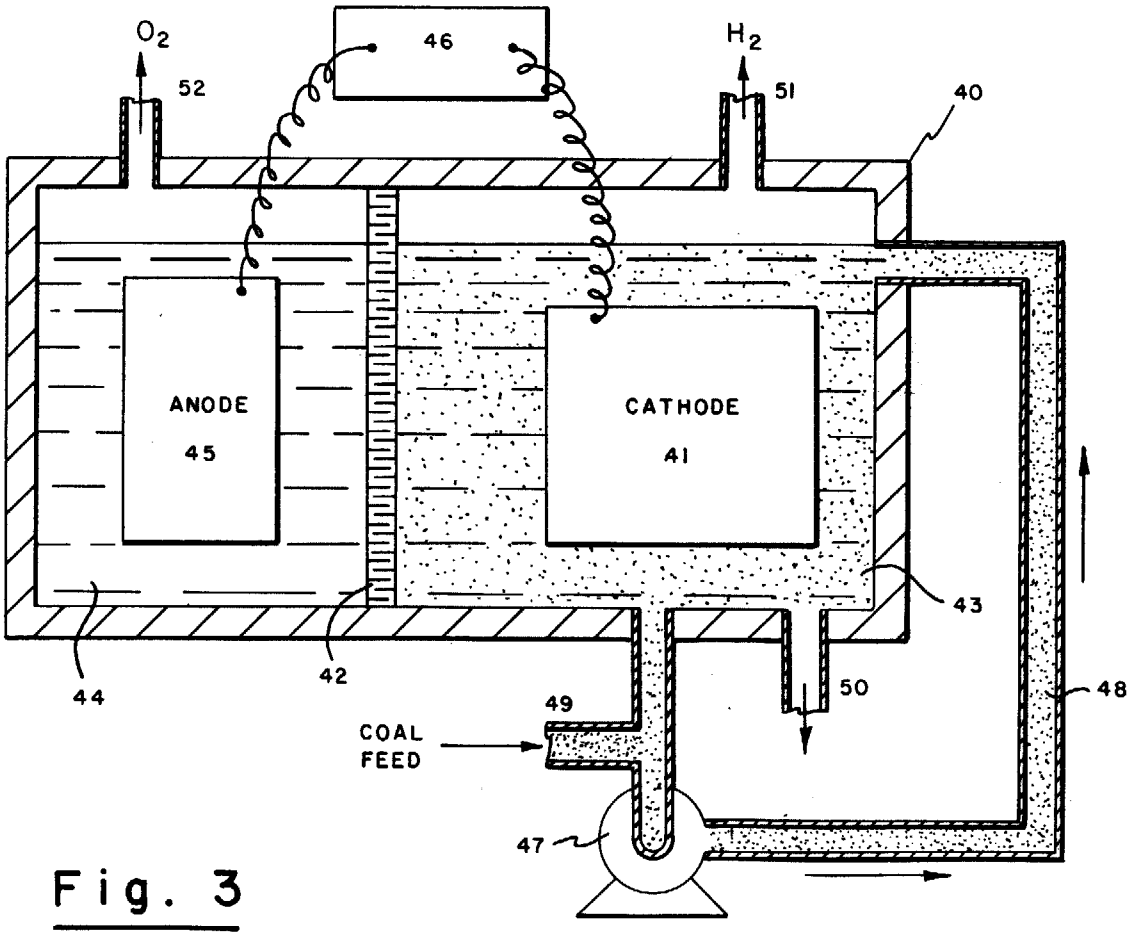
FIG. 3 is a schematic diagram depicting the electrochemical hydrogenation of coal at the cathode of an electrochemical cell.

FIG. 3 shows a schematic diagram of an electrolytic cell 40 adapted to accomplish cathodic electrochemical hydrogenation of coal. The cell is provided with a cathode 41 and membrane 42 that is permeable to ions but not to coal particles and through which membrane the cathode compartment 43 is connected to the anode compartment 44. Anode 45 and cathode 41 are connected by wires to DC power supply 46. Within the cathode compartment 43 the catholyte is a slurry of coal in aqueous electrolyte; this slurry is circulated by pump means 47 through conduit means 48 thereby keeping the slurry in motion and also keeping the coal suspended in the catholyte and thereby causing contact of the coal particles with the cathode 41. Fresh coal can be fed to the cell at 49 and hydrogenated coal removed at 50, with the relative rates of coal addition and removal governing the main holding time or residence time of the coal in the cathode compartment and, therefore, the extent of hydrogenation of the coal that is caused. Means are provided at 51 for removing $H_2$ gas should any be generated within the cathode compartment. The anolyte within the anode compartment 44 is aqueous electrolyte. Because no coal is present in the anolyte the only significant product generated in the anode compartment is $O_2$ and means are provided for removing such $O_2$ at 52. During operation of the process and apparatus of FIG. 3, it may be necessary to add water to either anode or cathode compartment of the cell in a slow continuous stream, or periodically, to make up for the water consumed by electrolysis; means are not shown for such water addition. A suitable overall cell potential for operation of the FIG. 2 process and apparatus is about 2 volts; a suitable aqueous electrolyte is a 20% solution of $H_2SO_4$.

Figure 4:
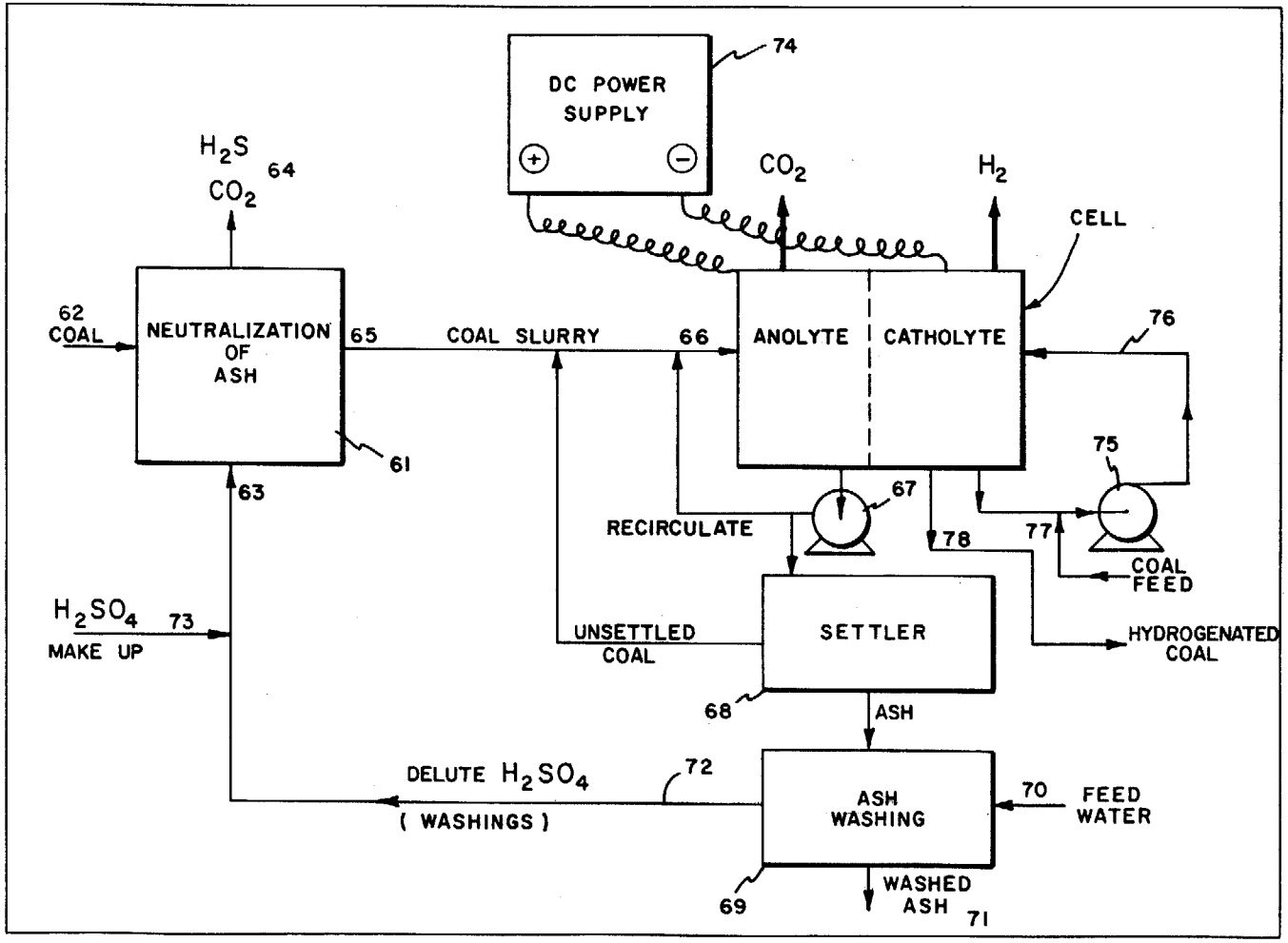
FIG. 4 is a schematic flow diagram showing the electrochemical gasification of coal at the anode and electrochemical hydrogenation of coal at the cathode of the same cell.

FIG. 4 shows schematically method and apparatus for hydrogenating coal in the cathode compartment of a cell while conducting anodic oxidation of coal at the anode within the anode compartment of the same cell. In FIG. 4, the cathode-compartment portion of the process, apparatus and coal-circulation system is essentially the same as that of FIG. 3, whereas the anode-compartment portion of the process, apparatus and coal-circulation system is essentially the same as that of FIG. 2. Coal and acidic electrolyte are fed to neutralization vessel 61 at 62 and 63, respectively, and gases such as $CO_2$ and $H_2S$ formed by neutralization of basic components of the coal ash are withdrawn at 64. Coal suspended in acidic electrolyte flows from neutralizer 61 at 65 to the anode compartment of the cell at 66. Pump means 67 are provided for circulating the anolyte coal slurry thereby keeping it in motion within the anode compartment of the cell so that the coal can make contact with the anode. A portion of this coal slurry also flows from pump means 67 to settling means 68 where ash is removed and washed in washing unit 69. Fresh feed water is fed at 70, washed ash is removed at 71, and the dilute-electrolyte washings are recirculated via conduit 72 to the neutralization vessel at 63. Make-up acid is added to the system as needed at 73 and a DC electric potential is applied to the cell from power supply 74. Suitable overall operating cell potentials are 0.7 to 1.1 volt and higher. Pump means 75 and conduit means 76 are provided for circulating the coal slurry of the cathode compartment to insure motion thereof and contact between coal particles and the cathode. Means are provided for feeding fresh coal at 77 and removing hydrogenated coal at 78. It should be noted that it will often be desirable to provide additional neutralization means in the FIG. 3 or FIG. 4 processes for accomplishing neutralization of the basic components of the coal fed to, and circulating through, the cathode compartments; such means are not shown in FIGS. 3 and 4 in order to keep the diagrams from appearing overly complex.

FIGS. 1 through 4 show processes which use, or imply the use of, acidic aqueous electrolytes. It is also possible to use many other electrolytes known in the art. When the electrolyte is not acidic, it will often be possible to avoid ash-neutralization procedures mentioned above and shown in some of the drawings. For the electrodeposition of metals there is no particular need for an electrolyte that provides protons and, as mentioned above, molten salts [e.g. metal chlorides, sulfates or nitrates] will often be useful and desirable electrolytes for electrodeposition of metals; in such cases it will often be desirable that the starting metal compound, which may be represented by the assumed chemical formula $M_mX_x$ will have a component X which will react anodically with coal thereby lowering operating cell voltage below that required to liberate or otherwise react itself at the anode. For embodiments in which coal is hydrogenated at the cathode, it will be necessary to have an electrolyte which provides hydrogen ions; water will often be such a suitable component of an electrolyte but other electrolytes, e.g. liquid $NH_3$ can provide the required $H^+$ ions.

In one embodiment of my invention coal is anodically oxidized in the anode compartment and hydrogenated within the cathode compartment of the cell. It will often be most convenient to practice this novel art by employing coals more suitable to anoidic oxidation (e.g. lower-ranked coals such as lignites) within the anode compartment and other coals more suitable to hydrogenation (e.g. higher ranked coals such as bituminous) within the cathode compartment.

It should also be noted that gaseous components can be reacted at the electrodes; for example, methane or hydrogen may be anodically oxidized while metal is electrodeposited at the cathode; or coal may be anodically oxidized while a reactive chemical such as carbon monoxide gas may be hydrogenated at the cathode. Preferred embodiments of the invention will often employ heterogeneous catalysts (e.g. metal or metal oxide particles suspended in the electrolyte) or homogeneous catalysts within either catholyte or anolyte to accelerate the chemical reactions at the cathode, at the anode, or in both locations.

EXAMPLES

Example 1—Metal Electrodeposition By Conventional Process Without Coal

Electrodeposition of Cu was conducted at constant current (i.e., galvanostatically) in a cell similar to that shown in FIG. 1, except that there was no external circulation system and no settling means. The anolyte, which did not contain coal for this Example, was stirred using a conventional magnetic stirring bar. The catholyte was not stirred and the membrane was porous fritted glass. The aqueous electrolyte was 0.125 M in $CuSO_4$ and 0.5 M in $H_2SO_4$ and the total electrolyte volume was 80 $cm^3$; temperature was 60° C. The anode was 5.3 $cm^2$ of Pt gauze, 52 gage; cathode was 8.4 $cm^2$ of the same gauze. The results of these experiments under different galvanostatic conditions are summarized as follows:

| Current | Cell Potential | Current Efficiency | Specific Electric Power Consumption |
|---|---|---|---|
| 5.9 mA | 1.65V | 91.2% | 1.52 kw hr/kgm Cu |
| 12.0 mA | 1.75V | 97.2% | 1.62 kw hr/kgm Cu |

Here current efficiency is defined as the number of electrochemical equivalents of Cu deposited on the cathode divided by the number of electrochemical equivalents of electric charge passed during the experiment. Specific electric power consumption is the amount of electrical energy consumed divided by the corresponding mass of Cu deposited on the cathode. These experiments were conducted for several hours.

Example 2—Metal Electrodeposition By Coal-Assisted Process Using Coal Suspended In Anolyte Apparatus and conditions are identical to those of Example 1 except that the stirred anolyte contained 0.15 gm/$cm^3$ of North Dakota Lignite of particle size range 74–88 μm. The corresponding results were as follows:

| Current | Potential | Current Efficiency | Specific Electric Power Consumption |
|---|---|---|---|
| 5.9 mA | 0.50 | 89.4% | 0.47 kw-hr/kg Cu |
| 12.0 mA | 0.605 | 95.2% | 0.55 kw-hr/kg Cu |

During these exmperiments, also conducted for several hours, gaseous oxides of carbon (mostly carbon dioxide) were produced at the anode. A notable feature is the significant lowering of cell potential due to the reaction of the lignite to produce oxides of carbon in the anode compartment and especially the greatly lowered consumption of electric power per kg of copper electrodeposited; the specific consumption of electrical energy is lowered by about two-thirds due to the anodic reaction of the coal.

Example 3—Cathodic Hydrogenation of Coal

The apparatus was essentially the same as that of the previous two experiments. The electrolyte, which was a 20% aqueous solution of $H_2SO_4$, contained no copper. When the cell was operated at a potential of 2.25 V and a temperature of 120° C. with no coal present, hydrogen was produced in the cathode compartment and oxygen in the ande compartment in the relative volumetric proportions (i.e., molar proportions) of $H_2/O_2=2.0$. When Pittsburgh Seam Coal, particle size 125–149 μm, was present in the stirred cathode compartment at a concentration of 0.069 gm/cm$^3$, but with other conditions essentially the same, then 20–40% less hydrogen was produced over the course of several experiments. This lowered hydrogen production corresponded to the hydrogen that reacted with the coal to hydrogenate it. In no case was $CO_2$ detected at the anode (there was no coal in the anode compartment)—even during experiments to hydrogenate coal present in the cathode compartment. During the hydrogenation of coal in the cathode compartment a trace of $H_2S$ was produced there.

The foregoing examples and embodiments are given for illustrative purposes only and are not intended to limit the scope of the invention. For example, I have found that a wide variety of carbonaceous and hydrocarbonaceous materials will react at the electrodes during the operation of my invention: bituminous coal, chars made from coal, lignite, peat, active carbons, coke, carbon blacks, and even graphite. Many types of materials are suitable for the electrodes. Cathodes may be of graphite, nickel, aluminum, steel, copper or one of the precious metals. Anodes are subjected to more corrosive conditions and must be of more resistant materials; I have found that graphite rods, graphite felt and Pt gauze make satisfactory anodes. Several complex metal oxides which are inert but conductive such as perovskites or scheelites are also suitable anode materials. In the Examples and Embodiments cell membranes have been shown. Although membranes are not always necessary, preferred embodiments will ordinarily employ membranes to prevent solid carbonaceous particles from migrating between cathode and anode and thus undergoing successive oxidation and reduction reactions which could waste electrical energy. It will often be possible, however, to design cells with specific flow patterns that will keep certain coal particles within the environment of the anode only and, if other coal is to be cathodically reduced, to keep those other coal particles within the environment of the cathode only. Suitable materials for cell membranes are well known in the art, porous fritted glass, spun or woven asbestos, porous reinforced polymers and many other materials of suitable porosity can be used. By my invention it is possible to electrowin, electroplate or electrodeposit any element that can be cathodically reduced from solution with simultaneous electrochemical anodic oxidation of carbonaceous material. Typical metallic elements often deposited in practice from aqueous electrolytes include Cr, Mn, Co, Ni, Cu, ZnGa, Cd, In and Tl. As pointed out above, however, it is also possible to practice the invention with nonaqueous electrolytes, e.g. molten salts; such electrolytes might be employed for the coal-assisted electrodeposition of elements such as Al, Zr, Hf, Ta, Nb and W.

Various aqueous electrolytes that can be employed in my invention include solutions of sulfuric acid, nitric acid, phosphoric acid, sodium or potassium hydroxide or carbonates; sulfonic acids can also be used, for example, trifluoromethansulfonic acid. Aqueous solutions of metal salts are also suitable electrolytes, e.g. $CuSO_4$, $ZnCl_2$ or $ZnSO_4$. Various combinations of such electrolytes are also possible, in particular a buffered basic electrolyte would be advantageous for lowering the solubility of $CO_2$ formed at the anode.

For cathodic hydrogenation of coal aqueous electrolytes will often be preferred but many other nonaqueous electrolytes are possible provided they can supply the protons required for cathodic hydrogenation, i.e., the so-called "protic" as opposed to "aprotic". Some typical nonaqueous, protic electrolytes are HF, $NH_3$, methanol, and various formamides.

Although the examples given above refer to experiments at one atmospheric pressure, operation may be implemented at higher pressures, and higher temperatures than in the examples. Higher temperatures will permit operation at lower voltage with corresponding savings of electrical energy. Operation at higher pressures will not present serious problems because the pumping of coal slurries against high pressures is well known art; furthermore, the hydrogenation of coal or the production of other products, such as $H_2$ and $CO_2$ at higher pressures will require only very slightly higher operating potential. Production of high pressure hydrogen, or the hydrogenation of coal at high pressures, will frequently be advantageous and desirable.

I claim:

1. A method of electrowinning a metallic element from an electrolyte containing a metallic component as a cationic component, comprising the steps of:

introducing carbonaceous solids and said electrolyte into an electrolysis cell having a cathode electrode and an anode electrode; and applying an electromotive force across said electrodes;

whereby said carbonaceous solids react at said anode and said metallic component is deposited at said cathode.

2. The method as defined by claim 1 wherein said carbonaceous solids are selected from the group consisting of coal, lignite, peat, char, coke, charcoal, soot, carbon black, activated carbon and graphite.

3. The method as defined by claim 2 wherein said electrolyte is selected from the group consisting of aqueous solutions and nonaqueous melts.

4. The method as defined by claim 3 wherein said metallic element is selected from the group consisting of Cr, Mn, Co, Ni, Cu, Zn, Ga, Cd, In and Tl.

5. The method as defined by claim 3 wherein said metallic element is copper.

6. The method as defined by claim 5 wherein the copper electrolyte is obtained from copper ore, and further comprising the step of leaching copper ions from said copper ore using acidic catholyte from said cell.

7. The method as defined by claim 2 wherein said metallic element is copper.

8. The method as defined by claim 7 wherein the copper electrolyte is obtained from copper ore, and further comprising the step of leaching copper ions from said copper ore using acidic catholyte from said cell.

9. The method as defined by claim 2 wherein said electrolyte is an aqueous solution and oxides of carbon are produced at said anode.

10. The method as defined by claim 9 wherein said metallic element is selected from the group consisting of Cr, Mn, Co, Ni, Cu, Zn, Ga, Cd, In and Tl.

11. The method as defined by claim 9 wherein said metallic element is copper.

12. The method as defined by claim 11 wherein the copper electrolyte is obtained from copper ore, and further comprising the step of leaching copper ions from said copper ore using acidic catholyte from said cell.

13. The method as defined by claim 12 wherein said metallic element is selected from the group consisting of Cr, Mn, Co, Ni, Cu, Zn, Ga, Cd, In and Tl.

14. The method as defined by claim 1 wherein said electrolyte is selected from the group consisting of aqueous solutions and nonaqueous melts.

15. The method as defined by claim 1 wherein said electrolyte is an aqueous solution and oxides of carbon are produced at said anode.

16. The method as defined by claim 1 wherein said metallic element is copper.

17. The method as defined by claim 10 wherein the copper electrolyte is obtained from copper ore, and further comprising the step of leaching copper ions from said copper ore using acidic catholyte from said cell.

18. The method as defined by claim 1 wherein said metallic element is selected from the group consisting of Cr, Mn, Co, Ni, Cu, Zn, Ga, Cd, In and Tl.

* * * * *